US005188185A

United States Patent [19]

Mears

[11] Patent Number: 5,188,185

[45] Date of Patent: Feb. 23, 1993

[54] DRY SPRINKLER

[75] Inventor: James W. Mears, Warwick, R.I.

[73] Assignee: Grinnell Corporation, Exeter, N.H.

[21] Appl. No.: 717,640

[22] Filed: Jun. 19, 1991

[51] Int. Cl.[5] ..... A62C 37/09

[52] U.S. Cl. ..... 169/37; 169/38

[58] Field of Search ..... 169/37, 38, 41

[56] References Cited

U.S. PATENT DOCUMENTS

| | | | |
|---|---|---|---|
| 427,418 | 5/1890 | Hill | 169/41 |
| 1,338,469 | 4/1920 | Waage et al. | 169/37 X |
| 1,903,150 | 3/1933 | Tyden . | |
| 2,044,313 | 6/1936 | Lowe | 169/37 X |
| 2,732,018 | 1/1956 | Grimes . | |
| 2,768,696 | 10/1956 | Sherburne . | |
| 3,007,528 | 11/1961 | Gloeckler . | |
| 3,061,015 | 10/1962 | Cann, Jr. . | |
| 3,080,000 | 3/1963 | Gloeckler . | |
| 3,584,689 | 6/1971 | Willms . | |
| 4,007,878 | 2/1977 | Anderson . | |
| 4,177,862 | 12/1979 | Bray . | |
| 4,228,858 | 10/1980 | Sclafani . | |
| 4,417,626 | 11/1983 | Hansen . | |

OTHER PUBLICATIONS

Dry Pendent Sprinkler GHTS 15, Kennblatt-Nr. 4-04-4-03, Total Walther Feuerschutz GmbH.

Model G3 Dry Sprinkler, The Reliable Automatic Sprinkler Co., Inc., Nov. 1987.

Technical Data, Dry Pendent Sprinklers Model C, The Viking Corporation, Jan. 1987.

Model ME-1 Flush Type Dry Pendent, Chemetron Fire Systems.

Dry Pendent Sprinklers, Issue C Solder Type, ½" Orifice, Grinnell Corporation, Jul. 1986.

Dry Pendent Sprinkler Recessed, Flush and Extended Types Model "A-1", Central Sprinkler Corporation, 1986.

Automatic Sprinklers Model J Bulb Spray Series Dry Type Pendent Recessed Pendent, Globe Fire Sprinkler Corporation, Aug. 1990.

*Primary Examiner*—Charles A. Marmor
*Assistant Examiner*—Gary C. Hoge
*Attorney, Agent, or Firm*—Fish & Richardson

[57] ABSTRACT

A dry sprinkler for mounting on a piping system in a fire protection installation including an outer tube structure having an inlet end with an inlet opening, an outlet end having an outlet opening, and a tube axis that passes through the inlet opening and along the tube structure, a connecting structure that is mounted for movement along the axis within the tube structure, a thermally responsive component supported by the tube structure at the outlet end and supporting the connecting structure under normal temperature conditions and releasing the connecting structure during abnormal temperature conditions to permit it to move, a seal member that is caused by the connecting structure to seal the inlet opening when the connecting structure is supported by the thermally responsive component, the seal member being constrained to move towards one side of the tube axis when the connecting structure is released in order to provide a relatively large unobstructed flow area to permit passage of foreign matter on the other side of the axis.

15 Claims, 1 Drawing Sheet

DRY SPRINKLER

FIELD OF THE INVENTION

The invention relates to dry sprinklers for mounting on a piping system in a fire protection installation.

Dry sprinklers are used where the sprinklers may be exposed to freezing temperatures. A dry sprinkler typically includes a threaded inlet containing a plug, some length of tubing connected to the threaded inlet, and sprinkler components (e.g., a frame, deflector and thermally responsive component) located at the other end of the tubing. There also is some connecting mechanism that is located within the tubing and connects the thermally responsive component to the plug. The threaded inlet is at a location that is not subjected to freezing conditions. In some dry sprinklers, when the thermally responsive component releases, the plug is expelled from the sprinkler system by water pressure. In some other dry sprinklers, the plug is moved along the longitudinal tube axis a sufficient distance to clear the inlet opening and permit water flow around the sides of the plug.

SUMMARY OF THE INVENTION

The invention features, in general, a dry sprinkler that includes an outer tube structure having an inlet end and an outlet end, a thermally responsive component at the outlet end, a seal member at the inlet end, and a connecting structure between the thermally responsive component and the seal member. The seal member is retained in place in the inlet when the thermally responsive component is at normal temperature conditions and is constrained to move towards one side of the tube axis when the connecting structure is released by the operation of the thermally responsive component in order to provide a relatively large, unobstructed flow area to permit passage of foreign matter on the opposite side of the tube axis.

In preferred embodiments, the seal member is a plug that is pivotally mounted on a pivot axis on the connecting structure that is transverse to the tube axis. The connecting structure includes a yoke that has two-spaced parallel walls that support the plug. The parallel walls of the yoke have stop surfaces on both sides to permit pivoting of the plug to either side. A spring is used to cause the plug to be actively moved to an open position by spring force when the connecting structure is released by the operation of the thermally responsive component. The connecting structure includes a guide tube at the outlet end of the tube structure and a water tube between the yoke and the guide tube. The tube structure includes an inlet fitting, an outlet frame and a casing tube between the two. There also is a bulb seat in the frame between the thermally responsive component (a bulb) and the guide tube.

Other advantages and features of the invention will be apparent from the following description of a preferred embodiment thereof and from the claims.

DESCRIPTION OF THE PREFERRED EMBODIMENT

The drawings will first be described.

DRAWINGS

STRUCTURE

Figure 1:
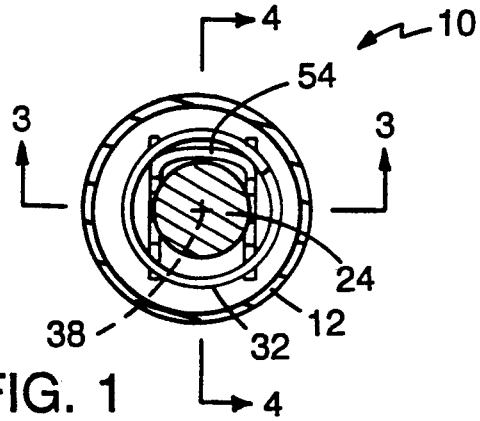
FIG. 1 is a horizontal sectional view, taken at 1—1 of FIG. 3, of a dry sprinkler according to the invention.
Figure 2:
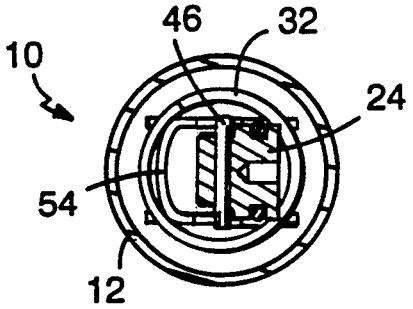
FIG. 2 is a horizontal sectional view, taken at 2—2 of FIG. 4, of the FIG. 1 dry sprinkler.
Figure 3:
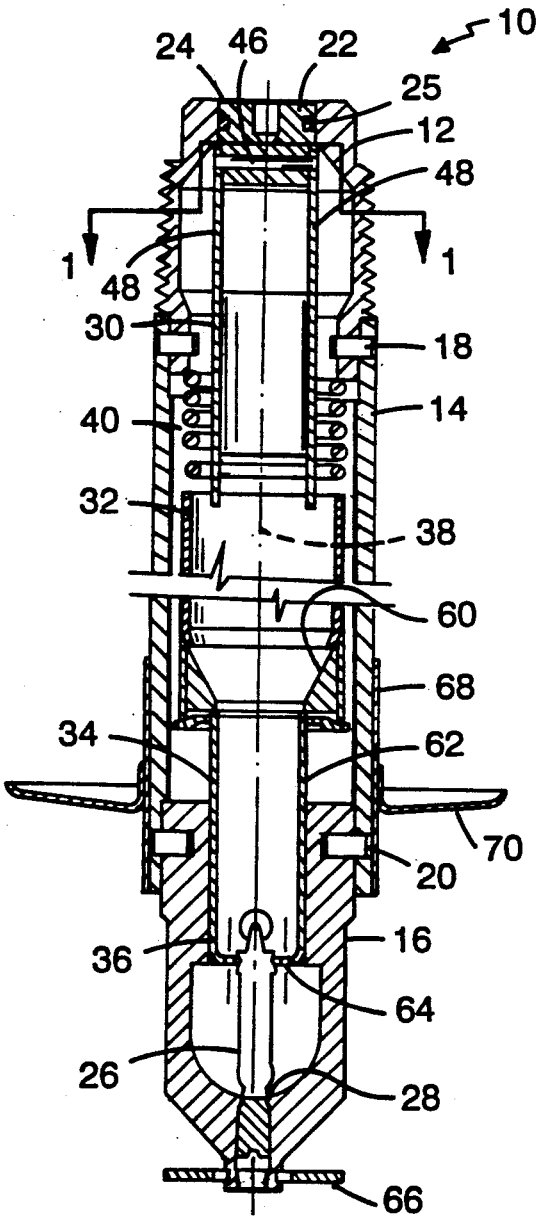
FIG. 3 is a vertical sectional view, taken at 3—3 of FIG. 1, of the FIG. 1 sprinkler, showing the sprinkler in a sealed condition.

Referring to FIGS. 1–4, there is shown dry sprinkler 10. It includes an outer tube structure made of inlet fitting 12, casing tube 14, and outlet frame 16. Casing tube 14 (which has a length, e.g., between about 2" and 48", that depends upon the particular installation) is attached to inlet fitting 12 via groove pins 18, and casing tube 14 is connected to outlet frame 16 via groove pins 20. Inlet fitting 12 has inlet opening 22 through it. Inletopening 22 is sealed off by plug 24 when in the normal temperature condition. Plug 24 has 0-ring 25 therearound within an annular recess. At the other end of sprinkler 10, thermally responsive bulb 26 is supported at its bottom via compression screw 28 in outlet frame 16.

Between bulb 26 and plug 24 is a connecting structure that is located within the outer tube structure. The connecting structure includes yoke 30, water tube 32 thereunder, guide 34 thereunder, and bulb seat 36 thereunder. The connecting structure is mounted for movement along longitudinal tube axis 38 and is biased in a direction from the inlet toward the outlet via compression spring 40, which acts between the lower surfaces of inlet fitting 12 and tabs 42 of yoke 30.

Plug 24 is mounted for pivoting about pivot axis 44 on pivot pin 46, which is supported at its two ends by parallel side walls 48 of yoke 30. Each side wall 48 has two stop surfaces 50 on opposite sides of pivot axis 44 that interfere with lip 52 of plug 24, preventing plug 24 from rotating more than 90° from its initial upright position. Plug 24 has only a small section below (when in the upright position) pivot pin 46, and the majority of the plug is above pivot pin 46. Thus, when plug 24 rotates, most of the plug is on one side of tube axis 38, and there is a large unobstructed flow area on the other side. Side walls 48 are joined via third wall 54, which ends at a distance below pivot axis 44, permitting a large unobstructed flow area into the region between walls 48 from the side.

At the bottom of each wall 48 is an extension 56 that extends downward from tabs 42 and sits within water tube 32. Tabs 42 sit on top of the upper surface of water tube 38. At the bottom of water tube 32 is insert 60, which has a converging, conical surface leading to guide tube 34. Guide tube 34 has drainage holes 62, and bulb seat 36 has drainage holes 64. Deflector 66 is connected to the bottom of frame 16. Mounting cup 68 and escutcheon plate 70 are around the outside of casing tube 14 at the bottom.

OPERATION

Figure 4:
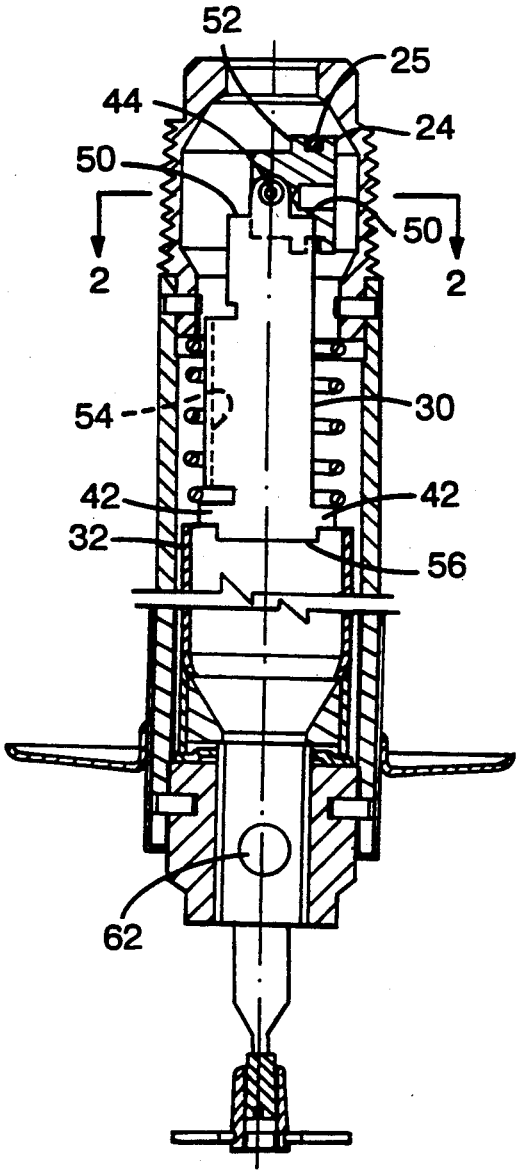
FIG. 4 is a vertical sectional view, taken at 4—4 of FIG. 1 (with the exception of a yoke component, which is shown in full), of the FIG. 1 sprinkler in an activated condition.

In use, the threads of inlet fitting 12 are screwed into the piping system, which is located in a region that does not freeze. After installation of a ceiling panel (not shown), plate 70 is pushed up against the ceiling panel. This leaves outlet frame 16 exposed below the ceiling panel at a location where it can sense abnormal temperature conditions (e.g., caused by a fire) and distribute water. Plug 24 is located at a position where freezing does not occur. When in the standby, unactuated position shown in FIG. 3, plug 24 seals off opening 22 to the water supply piping system, and any condensation within casing tube 14 can drain through drainage holes 62, 64. When an abnormal temperature condition is sensed by thermally responsive bulb 26, bulb 26 breaks, and the connecting structure is biased downward by compression spring 40. Bulb seat 36 is ejected from outlet frame 16, and yoke 30, water tube 32 and guide tube 34 are pushed downward. Spring 40 thus actively pushes plug 24 downward regardless of the water pressure above it. When plug 24 is initially pushed downward, it is in a vertically upright position which is unstable. Plug 24 will be quickly moved by water flow to one side, either to the right (as shown in FIG. 4) or to the left, and water will flow predominantly around the other side of plug 24 through a large unobstructed flow region that permits the passage and prevents the lodgement of water born debris. The chamber within inlet fitting 12 and the movement and dimensions of plug 24 permit passage of a ⅜" diameter sphere and avoid the need for screens or other components to block debris from entering the sprinkler.

Water tube 32 has a large diameter along its length, minimizing friction loss effects over its relatively long length. Reduced flow areas exist only at inlet opening 22 and at the outlet, keeping friction losses to a small amount. The water emerging from the outlet is dispersed by deflector 66 over the area to be protected.

Other embodiments of the invention are within the scope of the appended claims.

What is claimed is:

1. A dry sprinkler for mounting on a piping system in a fire protection installation comprising an outer tube structure having an inlet end with an inlet opening, an outlet end having an outlet opening, and a tube axis that passes through said inlet opening and along said tube structure, said tube structure including an elongated tube between said inlet opening and outlet opening a connecting structure that is mounted for movement along said tube axis within said tube structure, a thermally responsive component supported by said tube structure at said outlet end and supporting said connecting structure under normal temperature conditions and releasing said connecting structure during abnormal temperature conditions to permit it to move, a seal member that is located within said tube structure and is caused by said connecting structure to seal said inlet opening under normal temperature conditions when said connecting structure is supported by said thermally responsive component, coupling means for attaching said seal member to said connecting structure and for facilitating movement of said seal member with respect to said connecting structure when said connecting structure moves along said axis, said seal member being constrained to move away from said tube axis towards said outer tube structure on one side of axis when said connecting structure is released and moves along said tube axis in order to provide a relatively large unobstructed flow area to permit passage of foreign matter on the opposite side of said axis.

2. The sprinkler of claim 1 wherein said seal member is a plug and said coupling means includes a pivotal connection for pivoting said plug about a pivot axis on said connecting structure.

3. The sprinkler of claim 2 wherein said plug axis intersects and is transverse to said tube axis.

4. The sprinkler of claim 3 wherein said connecting structure comprises two spaced walls extending parallel to and on opposite sides of said tube axis, said pivot axis passing from one said wall to the other.

5. The sprinkler of claim 4 wherein said walls have stop surfaces preventing continued pivoting of said plug beyond a stop position located at one side of said pivot axis.

6. The sprinkler of claim 5 wherein said plug can pivot in either direction, and there are stop surfaces on both sides of said pivot axis.

7. The sprinkler of claim 6 wherein said tubular structure has a flow area on both sides of said pivot axis near said plug to accommodate said plug on one side and provide an unobstructed flow passage on the other side.

8. The sprinkler of claim 7 wherein said walls are part of a yoke of said connecting structure, and said yoke has a third wall joining said two walls to each other, said third wall ending at a distance along said tube axis spaced from said pivot axis so as to provide a flow passage into the space between said walls downstream of said plug.

9. The sprinkler of claim 2 wherein said inlet opening has a cylindrical inner surface, and said plug has a mating cylindrical outer surface.

10. The sprinkler of claim 1 further comprising a spring that is mounted in said tubular structure so as to cause said seal member to unseal said inlet opening when said connecting structure is released by operation of said thermally responsive component.

11. The sprinkler of claim 2 further comprising a spring that is mounted in said tubular structure to bias said connecting structure toward said outlet end so as to cause said connecting structure to be moved toward said outlet end and said plug to unseal said inlet opening when said connecting structure is released by operation of said thermally responsive component.

12. The sprinkler of claim 8 further comprising a spring that is mounted in said tubular structure to bias said yoke toward said outlet end so as to cause said connecting structure to be moved toward said outlet end and said plug to unseal said inlet opening when said connecting structure is released by operation of said thermally responsive member.

13. The sprinkler of claim 8 wherein said connecting structure includes a water tube that supports said yoke and a guide tube that supports said water tube, is located in said outlet opening, has a smaller flow area than said connecting tube, and is supported by said thermally responsive component.

14. The sprinkler of claim 13 wherein said tubular structure includes an inlet fitting that provides said inlet opening, an outlet frame that provides said outlet opening and supports said thermally responsive component, and a casing tube between the two.

15. The sprinkler of claim 14 wherein said thermally responsive component is a frangible bulb, and wherein said connecting structure further comprises a bulb seat in said outlet opening in said frame between said bulb and said guide tube.

* * * * *